US008955646B2

(12) United States Patent
Takahashi et al.

(10) Patent No.: US 8,955,646 B2
(45) Date of Patent: Feb. 17, 2015

(54) DEVICE FOR LUBRICATING OIL SEAL OF ENGINE

(75) Inventors: Miyuki Takahashi, Kanagawa-ken (JP); Masaki Endo, Kanagawa-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 438 days.

(21) Appl. No.: 11/727,361

(22) Filed: Mar. 26, 2007

(65) Prior Publication Data

US 2007/0235262 A1 Oct. 11, 2007

(30) Foreign Application Priority Data

Mar. 29, 2006 (JP) ..... 2006-092125

(51) Int. Cl.
*F01M 11/02* (2006.01)
*F01M 1/08* (2006.01)

(52) U.S. Cl.
CPC ..... *F01M 1/08* (2013.01)
USPC ..... 184/6.5; 184/11.2; 123/196 R; 239/596; 277/549

(58) Field of Classification Search
USPC ..... 184/6.5, 11.2, 6.26, 6.11, 15.3, 54, 184/50.2, 6.12; 239/596, 589, 601, 602, 239/543, 552; 277/549; 123/196 R, 196 AB, 123/196 M
See application file for complete search history.

(56) References Cited

U.S. PATENT DOCUMENTS 2,874,803 A * 2/1959 Gunberg ..... 184/6.11
2,929,467 A * 3/1960 Larkin et al. ..... 184/6.1
2,956,824 A * 10/1960 Kuchler et al. ..... 277/500
2,992,842 A * 7/1961 Shevchenko et al. ..... 277/306
3,003,338 A * 10/1961 Backman Wong ..... 464/16
3,687,231 A * 8/1972 Scheiterlein ..... 184/6.5
3,746,128 A * 7/1973 Wunsch ..... 184/6.11
4,122,818 A * 10/1978 Hattori ..... 123/196 AB
4,123,069 A * 10/1978 Sato ..... 277/391
4,157,045 A * 6/1979 Suzuki ..... 475/160
4,204,487 A * 5/1980 Jones ..... 123/41.35

(Continued)

FOREIGN PATENT DOCUMENTS

JP 63-188319 12/1988
JP 2000-213321 8/2000

(Continued)

OTHER PUBLICATIONS

Machine Translation of JP2000-213541.*

*Primary Examiner* — Gene Crawford
*Assistant Examiner* — Terry Chau
(74) *Attorney, Agent, or Firm* — Wenderoth, Lind & Ponack, L.L.P.

(57) ABSTRACT

A device for lubricating an oil seal of an engine which is simple in construction and low in manufacturing cost without the need for providing piping for supplying lube oil to the oil seal and with which lube oil can be supplied sufficiently and properly to the oil seal to prevent overheating of the oil seal which induces oil leakage and occurrences of damage to the oil seal. The lubricating device has an oil seal which contacts a side face of a disk plate fixed to an end of a crankshaft of the engine and seals a gear room of the engine from outside, wherein an oil injection nozzle is attached to an end face of a crankcase of the engine such that the oil injection nozzle is in communication with a main oil gallery of the engine and oil in the main oil gallery is sprayed toward the slide contacting part of the oil seal.

14 Claims, 2 Drawing Sheets

(56) References Cited

U.S. PATENT DOCUMENTS

| | | | | | |
|---|---|---|---|---|---|
| 4,429,587 | A | * | 2/1984 | Finn et al. | 74/467 |
| 4,862,838 | A | * | 9/1989 | Hodgkins et al. | 123/41.35 |
| 4,869,211 | A | * | 9/1989 | Heberle et al. | 123/41.35 |
| 4,969,652 | A | * | 11/1990 | Munson | 277/543 |
| 5,097,926 | A | * | 3/1992 | Duello | 184/6.4 |
| 5,190,121 | A | * | 3/1993 | Muzyk | 184/6.5 |
| 5,975,534 | A | * | 11/1999 | Tajima et al. | 277/353 |

FOREIGN PATENT DOCUMENTS

| | | |
|---|---|---|
| JP | 2000-213541 | 8/2000 |
| JP | 2000-282828 | 10/2000 |

* cited by examiner

DEVICE FOR LUBRICATING OIL SEAL OF ENGINE

BACKGROUND OF THE INVENTION

1. Field of the Invention

The present invention relates to a device for lubricating an oil seal which performs sealing of a gear room of an engine against oil leakage to the outside of the engine by contacting a side face of a disk plate fixed to a crankshaft of a diesel engine.

2. Description of the Related Art

In some high speed diesel engines, a disk plate is fixed to an end of the crankshaft, an oil seal of flat surface sealing type is provided to contact a side face of the disk plate, and a gear room of the crankshaft end side is sealed against oil leakage to the outside with the oil seal of flat surface sealing type.

In such an engine, in order to prevent oil leakage from the oil seal due to overheating of the oil seal contacting the side face of the disk plate which is fixed to the crankshaft and rotates at high speed, the oil seal is cooled by oil drops falling down onto the slide contacting part of the oil seal in the gear room.

A device for lubricating an oil seal of an engine is disclosed in Japanese Laid-Open Patent Application No. 2000-282828A.

In the art disclosed in JP2000-282828A, an oil seal contacting the outer circumference of the hub of a crank pulley is attached to a timing chain cover in which an oil pump is integrated, a pressure regulating valve is provided to the oil pump, a portion of the oil released to regulate oil pressure is introduced to a hole provided in the chain cover to be supplied to the slide contacting part of the oil seal. Thus, by supplying oil positively to the slide contacting part of the oil seal, to which conventional oil leaked from the oil pump was utilized for lubrication of the oil seal, lubrication of the oil seal is improved and occurrence of oil leaks due to wear of the oil seal lip is prevented.

Conventionally, air born droplets in the gear room or oil which falls down along the wall of the gear case is utilized to cool and lubricate the slide contacting part of the oil seal, so a sufficient amount of oil can not be supplied to cool and lubricate the slide contacting part of the oil seal particularly in the case of a high speed engine in which the sliding speed at the slide contacting part is very high, and overheating of the oil seal due to a shortage in oil supply tends to occur.

With the art disclosed in JP2000-282828A, a part of the oil released to regulate oil pressure is supplied to the slide contacting part of the oil seal and overheating of the oil seal and occurrences of damage in the oil seal due to a shortage in oil supply can be prevented; however, oil supplied to the slide contacting part of the oil seal is a portion of the oil released to regulate oil pressure, so it is difficult to be assured that the proper amount of oil is always introduced to the slide contacting part of the oil seal, and when excessive oil is supplied, oil leakage may occur.

SUMMARY OF THE INVENTION

An object of the present invention is to overcome the problems of the prior art. The present invention provides a device for lubricating an oil seal of an engine which is simple in construction and low in manufacturing cost without the need for providing piping for supplying lube oil to the oil seal and with which lube oil is supplied sufficiently and properly to the oil seal to prevent overheating of the oil seal which induces oil leak and occurrences of damage to the oil seal.

To attain the object, the present invention comprises a device for lubricating an oil seal of an engine having an oil seal which contacts a side face of a disk plate fixed to an end of a crankshaft of the engine and seals a gear room of the engine from the outside, wherein an oil injection nozzle is attached to an end face of a crankcase of the engine such that the oil injection nozzle communicates with a main oil gallery of the engine and oil in the main oil gallery is sprayed toward the oil seal to its slide contacting part.

It is preferable that the oil injection nozzle is constructed such that; a nozzle member having an oil injection hole is detachably attached to the end face of the crankcase to cover an oil well which is formed on the end face of the crankcase and communicates with the main oil gallery with an opening of the injection nozzle hole communicating with the oil well and the axis line of the oil injection hole being directed to the slide contacting part of the oil seal, and oil is introduced from the main oil gallery to the oil well to be sprayed through the oil injection hole from the other side opening of the oil injection hole.

It is also preferable that a plurality of oil injection holes are provided, and oil is sprayed from the plurality of oil injection holes to a plurality of portions along the slide contacting part of the oil seal.

According to the present invention, pressurized oil is introduced from the mail oil gallery to the oil injection nozzle to be injected as a high speed oil jet stream to the side face, which is vertical to the axis line of the crankshaft, of the disk plate fixed to an end of the crankshaft, specifically to the slide contacting part of the oil seal to cool and lubricate the slide contacting part of the oil seal, so a sufficient oil film is formed on the surface of the slide contacting part of the oil seal with the oil sprayed from the injection hole of which the diameter is determined to supply the proper amount of oil so that sufficient cooling and lubrication of the oil seal is assured. Therefore, a temperature rise at the slide contacting part is suppressed, and oil leakage at the slide contacting part of the oil seal due to overheating of the slide contacting part can be prevented.

Since oil can be introduced from the main oil gallery to the oil injection hole via oil passages provided in the crankcase, oil piping is not needed. Therefore, cooling and lubrication of the slide contacting part of the oil seal can be improved without providing oil piping in particular, that is without increasing the number of parts, and with simple construction and low cost.

By constructing the nozzle member having the oil injection hole such that the nozzle member is attached detachably to an end face of the crankcase to cover the oil well which is formed on the end face of the crankcase and communicating to the main oil gallery with an opening of the oil injection hole communicating to the oil well and the axis line of the oil injection hole being directed to the slide contacting part of the oil seal, and oil is introduced from the main oil gallery to the oil well to be sprayed through the oil injection hole from the other side opening thereof, and further that a plurality of said oil injection holes are provided, and oil is sprayed from a plurality of the oil injection holes to a plurality of portions along the slide contacting part of the oil seal, the slide contacting part of the oil seal can be cooled and lubricated evenly along the circumference of the slide contacting part without allowing an oil starved area to occur in the circumference.

DETAILED DESCRIPTION OF THE INVENTION

A preferred embodiment of the present invention will now be detailed with reference to the accompanying drawings. It is intended, however, that unless particularly specified, dimensions, materials, relative positions and so forth of the constituent parts in the embodiments shall be interpreted as illustrative only not as limitative of the scope of the present invention.

Figure 1:
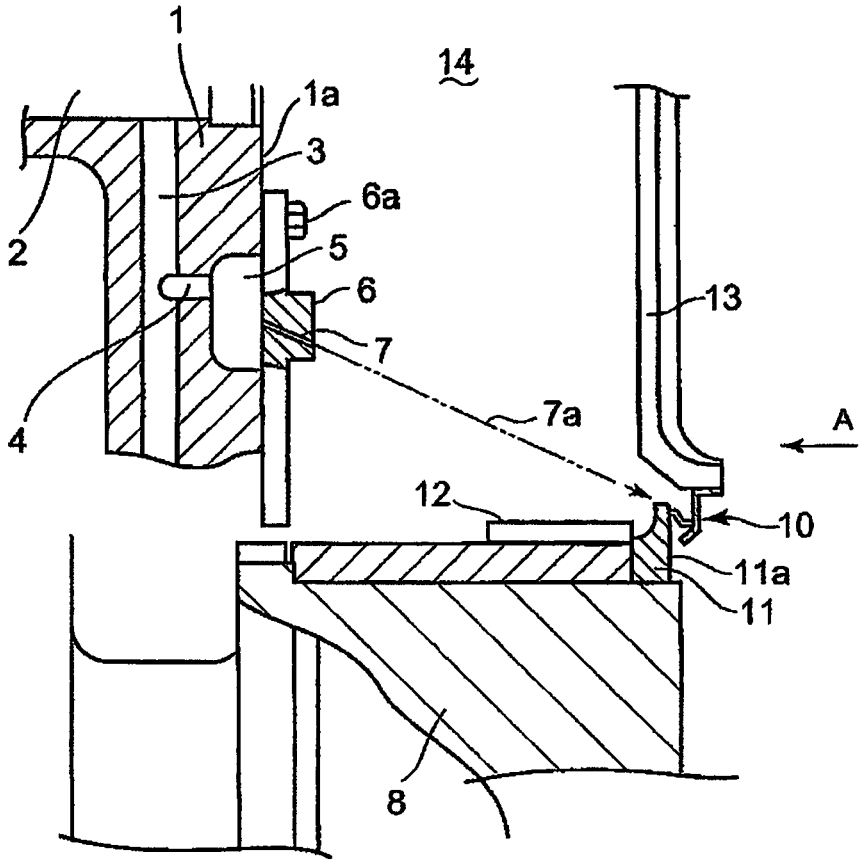
FIG. 1 is a longitudinal sectional view of a crankshaft end side part of a diesel engine showing an embodiment of the lubrication device of the present invention for lubricating an oil seal for sealing the end part of the crankshaft of the engine.
Figure 2:
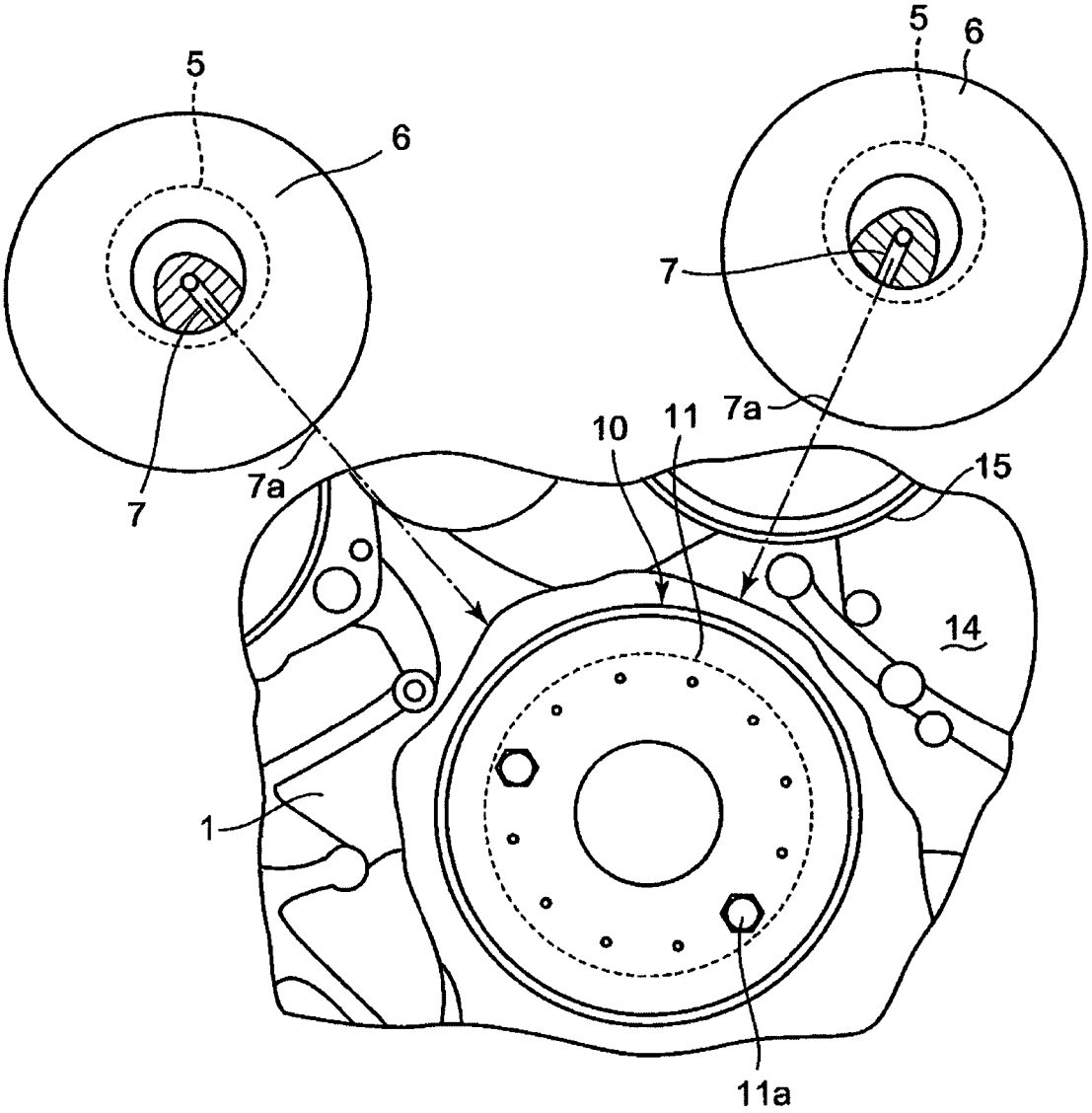
FIG. 2 is a view in the direction of arrow A in FIG. 1.

FIG. 1 is a longitudinal sectional view of a crankshaft end side part of a diesel engine showing an embodiment of the lubrication device of the present invention for lubricating an oil seal for sealing the end part of the crankshaft of the engine, and FIG. 2 is a view in the direction of arrow A in FIG. 1.

Referring to FIGS. 1-2, reference numeral 1 is a crankcase, 14 is a gear room where timing gears 15 are arranged, 13 is a gear case for covering the gear room 14. Reference numeral 8 is a crankshaft, 12 is a crank gear fixed to an end of the crankshaft 8 by spline connection.

Reference numeral 11 is a disk plate which is fixed by means of spline connection or press fit to the crankshaft 8 adjacent the crank gear 12.

Reference numeral 10 is an oil seal of flat surface sealing type fixed in the inner circumference of the gear case 13, which contacts a side face of the disk plate 11, i.e. a side face 11*a* vertical to the axis line of the crankshaft 8.

Sealing of the gear room 14 from outside at the end of the crankshaft 8 is performed by the oil seal 10.

Reference numeral 2 is a main oil gallery provided in the crankcase 1. Reference numeral 6 is a nozzle member fixed on an end face of the crankcase 1 by means of a plurality of bolts 6*a*, 7 is an oil injection hole drilled in the nozzle member 6. Two or more oil injection holes may be drilled in the nozzle member 6.

Reference numeral 5 is an oil well, a recess formed at an end of the crankcase 1. The oil well is covered with the nozzle member 6, and the oil injection hole 7 opens into the oil well. The oil injection hole 7 is drilled such that an oil jet stream 7*a* is directed to the slide contacting part of the oil seal 10.

In the embodiment shown in FIG. 2 two nozzle members 6, each having one oil injection hole 7 are provided and two oil jet streams 7*a* are directed to two portions at the slide contacting part of the oil seal 10. It is permissible that one such nozzle member is provided.

The oil well 5 is in communication with the main oil gallery 2 via an oil passage 3 and an oil passage 4 so that oil in the main oil gallery 2 is supplied to the oil well 5 via the oil passages 3, 4 and oil is sprayed from the oil injection hole 7 onto the slide contacting part of the oil seal 10.

In the embodiment, oil is introduced to the oil well 5 from the main oil gallery 2 through the oil passages 3 and 4. The oil pooled in the oil well 5 is sprayed through the oil injection hole 7 to the slide contacting part of the oil seal 10 to cool and lubricate there.

According to the embodiment, pressurized oil from the main oil gallery 2 is introduced to the oil injection hole 7, through which high speed oil jet stream 7*a* is sprayed toward the oil seal 10, the sprayed oil cools and lubricates the slide contacting part of the oil seal. Therefore, a sufficient oil film is formed on the slide face of the oil seal 10 to enable sufficient lubrication and a rise in temperature of the slide contacting part of the oil seal 10 is suppressed by the cooling effect of the sprayed oil 7*a*. Accordingly, the slide contacting part of the oil seal 10 is prevented from being heated excessively, and occurrences of oil leakage at the slide contacting part due to overheating of the slide contacting part can be prevented.

Since oil can be introduced from the main oil gallery 2 to the oil injection hole 7 via oil passages 3, 4 provided in the crankcase 1, oil piping is not needed. Therefore, cooling and lubrication of the slide contacting part of the oil seal 10 can be improved without providing oil piping in particular, that is without increasing the number of parts, and with simple construction and low cost.

By constructing the nozzle member 6 having the oil injection hole 7 such that the nozzle member is detachably attached to an end face of the crankcase 1 to cover the oil well 5 which is formed in the end face of the crankcase 1 and communicating to the main oil gallery 2 with an opening of the oil injection hole 7 communicating to the oil well 5 and the axis line of the oil injection hole 7 being directed to the slide contacting part of the oil seal 10, oil is introduced from the main oil gallery 2 to the oil well to be sprayed through the oil injection hole 7, and further two oil injection holes 7, 7 are provided to eject a plurality of oil jet streams (in this case two jet streams) onto the slide contacting part of the oil seal 10 at two portions thereof, the slide contacting part of the oil seal 10 can be cooled and lubricated evenly along the circumference of the slide contacting part without allowing oil starved area in the circumference.

According to the invention, a device for lubricating an oil seal of an engine can be provided which is simple in construction and low in manufacturing cost without need for providing piping for supplying lube oil to the oil seal and with which lube oil is supplied sufficiently to the oil seal to prevent overheat of the oil seal which induces oil leak and occurrence of damage of the oil seal.

The invention claimed is:

1. An arrangement for lubricating an oil seal of an engine, said arrangement comprising:

a gear case for covering an engine gear room where timing gears are arranged;

a crankcase located on a side facing the gear case across the engine gear room;

an oil seal fixed in an inner circumference of the gear case and configured to seal the engine gear room by extending between the gear case and a side face of a disk plate fixed to an end of a crankshaft, the oil seal having a slide contacting part located on a side of the gear case across the engine gear room from the crankcase;

a roof-shaped nozzle member detachably attached to an end face of the crankcase and facing the gear case across the engine gear room;

an oil injection hole disposed in the roof-shaped nozzle member such that an oil jet stream injected from the oil injection hole is directed to the slide contacting part of the oil seal located on a side of the gear case across the engine gear room; and an oil well that is a recess at the end face of the crankcase and has an opening covered with the roof-shaped nozzle member;

wherein the oil well communicates with a main oil gallery in the crankcase via an oil passageway so that a pressurized oil from the main oil gallery is capable of being injected as the oil jet stream from the oil injection hole via the oil passageway and the oil well to the slide contacting part of the oil seal located on the side of the gear case, the oil well being formed by a space on a back side of the roof-shaped nozzle member, the space having an area larger than a cross-sectional area of the oil passageway.

2. An arrangement according to claim 1, wherein said roof-shaped nozzle member includes a roof-shaped part which is detachable from said end face of the crankcase, and wherein the oil injection hole disposed in said roof-shaped nozzle member includes an oil injection nozzle passageway.

3. An arrangement according to claim 1, wherein said roof-shaped nozzle member includes an opening to which the oil well is connected via the oil injection hole, wherein the oil injection hole is arranged such that the oil passes from the oil well through the opening and is sprayed toward the slide contacting part of the oil seal, and wherein said roof-shaped nozzle member is configured to receive oil introduced to the oil well from the main oil gallery.

4. An arrangement according to claim 3, further comprising:

the crankshaft having the end; and the disk plate having the side face, the disk plate being fixed to the end of the crankshaft, wherein the side face of the disk plate contacts the oil seal.

5. An arrangement according to claim 4, wherein said crankshaft is part of an internal combustion engine.

6. An arrangement according to claim 1, wherein said gear case and said crankcase define said engine gear room.

7. An arrangement according to claim 1, wherein said roof-shaped nozzle member is attached to said end face of said crankcase by a plurality of bolts.

8. An arrangement according to claim 1, wherein said engine gear room is configured to be sealed by the oil seal, and wherein said roof-shaped nozzle member is disposed in said engine gear room.

9. An arrangement according to claim 8, wherein said gear case and said engine crankcase define said engine gear room.

10. An arrangement according to claim 1, wherein the oil injection hole is one of a plurality of oil injection holes, wherein the roof-shaped nozzle member is one of a plurality of roof-shaped nozzle members, wherein the plurality of the roof-shaped nozzle members are disposed around the oil seal, and wherein the plurality of oil injection holes are provided in the plurality of the roof-shaped nozzle members, respectively, the plurality of oil injection holes being configured and arranged to spray oil as the oil jet stream to a plurality of portions along the slide contacting part of the oil seal.

11. An arrangement according to claim 1, wherein the oil well communicates with the main oil gallery in the crankcase via the oil passageway, the oil passageway having a smaller cross sectional height than that of the oil well.

12. An arrangement for lubricating an oil seal of an engine, said arrangement comprising:

a crankshaft;

a disk plate fixed to an end of the crankshaft;

an engine gear room containing timing gears;

a gear case covering the engine gear room;

a crankcase located on a side facing the gear case across the engine gear room;

an oil seal fixed in an inner circumference of the gear case and contacting the disk plate to seal the engine gear room by extending between the gear case and the disk plate, the oil seal having a slide contacting part located on a side of the gear case across the engine gear room from the crankcase;

a roof-shaped nozzle member detachably attached to an end face of the crankcase and facing the gear case across the engine gear room;

an oil injection hole disposed in the roof-shaped nozzle member such that an oil jet stream injected from the oil injection hole is directed to the slide contacting part of the oil seal located on a side of the gear case across the engine gear room; and an oil well that is a recess at the end face of the crankcase and has an opening covered with the roof-shaped nozzle member, wherein the oil well communicates with a main oil gallery in the crankcase via an oil passageway to provide pressurized oil from the main oil gallery to the oil injection hole via the oil passageway, and the oil well is formed by a space on a back side of the roof-shaped nozzle member, the space having an area larger than a cross-sectional area of the oil passageway, wherein the oil seal is disposed on an opposite side of the engine gear room from the roof-shaped nozzle member, and the roof-shaped nozzle member is arranged such that the oil jet stream is injected from the oil injection hole across the engine gear room to the oil seal.

13. The arrangement of claim 12, wherein the oil injection hole is one of a plurality of oil injection holes, wherein the roof-shaped nozzle member is one of a plurality of roof-shaped nozzle members, wherein the plurality of the roof-shaped nozzle members are disposed around the oil seal, and wherein the plurality of oil injection holes are provided in the plurality of the roof-shaped nozzle members, respectively, the plurality of oil injection holes being configured and arranged to spray oil as the oil jet stream to a plurality of portions along the slide contacting part of the oil seal.

14. The arrangement of claim 12, wherein the oil well communicates with the main oil gallery in the crankcase via the oil passageway, the oil passageway having a smaller cross sectional height than that of the oil well.

* * * * *